US006383039B1

(12) United States Patent
Yoneyama et al.

(10) Patent No.: US 6,383,039 B1
(45) Date of Patent: May 7, 2002

(54) ELECTRICAL CONNECTOR

(75) Inventors: Atsushi Yoneyama, Nagano (JP); Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/822,911

(22) Filed: Mar. 29, 2001

(30) Foreign Application Priority Data

Dec. 30, 2000 (TW) ..... 89222913 U

(51) Int. Cl.[7] ..... H01R 23/02
(52) U.S. Cl. ..... 439/856; 439/682; 439/857
(58) Field of Search ..... 439/856, 857, 439/851, 852, 861, 862, 682, 660

(56) References Cited

U.S. PATENT DOCUMENTS 4,317,609 A * 3/1982 Lapraik ..... 439/857
5,334,053 A * 8/1994 Noschese ..... 439/856
6,102,754 A * 8/2000 Capper et al. ..... 439/857
6,171,126 B1 * 1/2001 Wu et al. ..... 439/856

* cited by examiner

*Primary Examiner*—Hien Vu
(74) *Attorney, Agent, or Firm*—Wei Te Chung

(57) ABSTRACT

An electrical connector (1) includes an insulative housing (2) and a number of conductive contacts (3). The insulative housing defines a number of receiving passageways (20) for receiving the conductive contacts. The receiving passageways each comprise a pair of opposite side walls (21) and an upper wall (22) between the side walls. Each side wall defines a mounting channel (23). The conductive contact includes a retaining portion (31), a mating portion (33) extending forwardly from the retaining portion and a tail portion (32) extending rearwardly from the retaining portion. The retaining portion and the mating portion are both received in the receiving passageway. The mounting portion forms a pair of opposite mounting shoulders (34) received in the mounting channels and a number of barbs (37) for engaging with the side walls. The contact forms a number of projections (35) for interference fitting with the upper wall of the receiving passageway.

1 Claim, 4 Drawing Sheets

ELECTRICAL CONNECTOR

BACKGROUND OF THE INVENTION

1. Field of the Invention

The present invention relates to an electrical connector, and particularly to an electrical connector which can securely retain conductive contacts thereof.

2. Description of Related Art

A conventional electrical connector retains conductive contacts in an insulative housing by a plurality of barbs interference fitting with the dielectric housing. Taiwan Patent Application Nos. 81205708 and 82200883 disclose a respective conventional electrical connector. Referring to FIG. 4, a respective conventional electrical connector includes an insulative housing 51 and a plurality of conductive contacts 50. Each of the conductive contacts 50 comprises a mounting portion 52 which is received in the insulative housing 51 and secures the conductive contact 50 in the insulative housing 51. The mounting portion 52 forms a plurality of barbs 55 extending outwardly from each edge thereof. A mating portion 53 extends upwardly from the mounting portion 52 for electrically contacting with mating electronic components (not shown). The contact 50 includes a tail portion 54 extending downwardly from the mounting portion 52 for electrically contacting with a corresponding printed circuit board (not shown).

In assembly, the barbs 55 of the mounting portion 52 is interference fitted with the insulative housing 51 and, therefore, the conductive contact 50 is mounted in the insulative housing 51. For an electrical contact transmitting electric power and thus having a largecross sectional area, the mounting manner described above is not stable. When contacts are inserted into a corresponding printed circuit board, they will sway to affect the electrical connection between the electric connector and the printed circuit board.

Hence, an improved electrical connector is required to overcome the disadvantages of the related art.

SUMMARY OF THE INVENTION

Accordingly, an object of the present invention is to provide an electrical connector which securely retains contacts in an insulative housing, whereby, a stable electrical connection between a mating electrical equipment and a corresponding printed circuit board can be achieved.

In order to achieve the object set forth, an electrical connector includes an insulative housing and a plurality of conductive contacts received in the dielectric housing. At least one contact of the conductive contacts transmits electric power. The insulative housing defines a plurality of receiving passageways for receiving the conductive contacts. The receiving passageways each comprise a pair of opposite side walls and an upper wall between the side walls. The side wall defines a mounting channel on a rear end thereof. Each of the conductive contact includes a retaining portion, a mating portion extending forwardly from the retaining portion and a tail portion extending rearwardly from the retaining portion. Both the retaining portion and the mating portion are received in the receiving passageway. The mounting portion forms on each edge thereof a pair of mounting shoulders received in the mounting channels and a plurality of barbs interference fitting with the side walls of the receiving passageway. The mounting portion forms a plurality of projections on a face thereof for interference fitting with the upper wall of the receiving passageway. The conductive contacts are securely retained in the receiving passageways by the mounting shoulder, the barbs and the projections engaging with the dielectric housing.

Other objects, advantages and novel features of the invention will become more apparent from the following detailed description when taken in conjunction with the accompanying drawings.

DETAILED DESCRIPTION OF THE INVENTION

Figure 1:
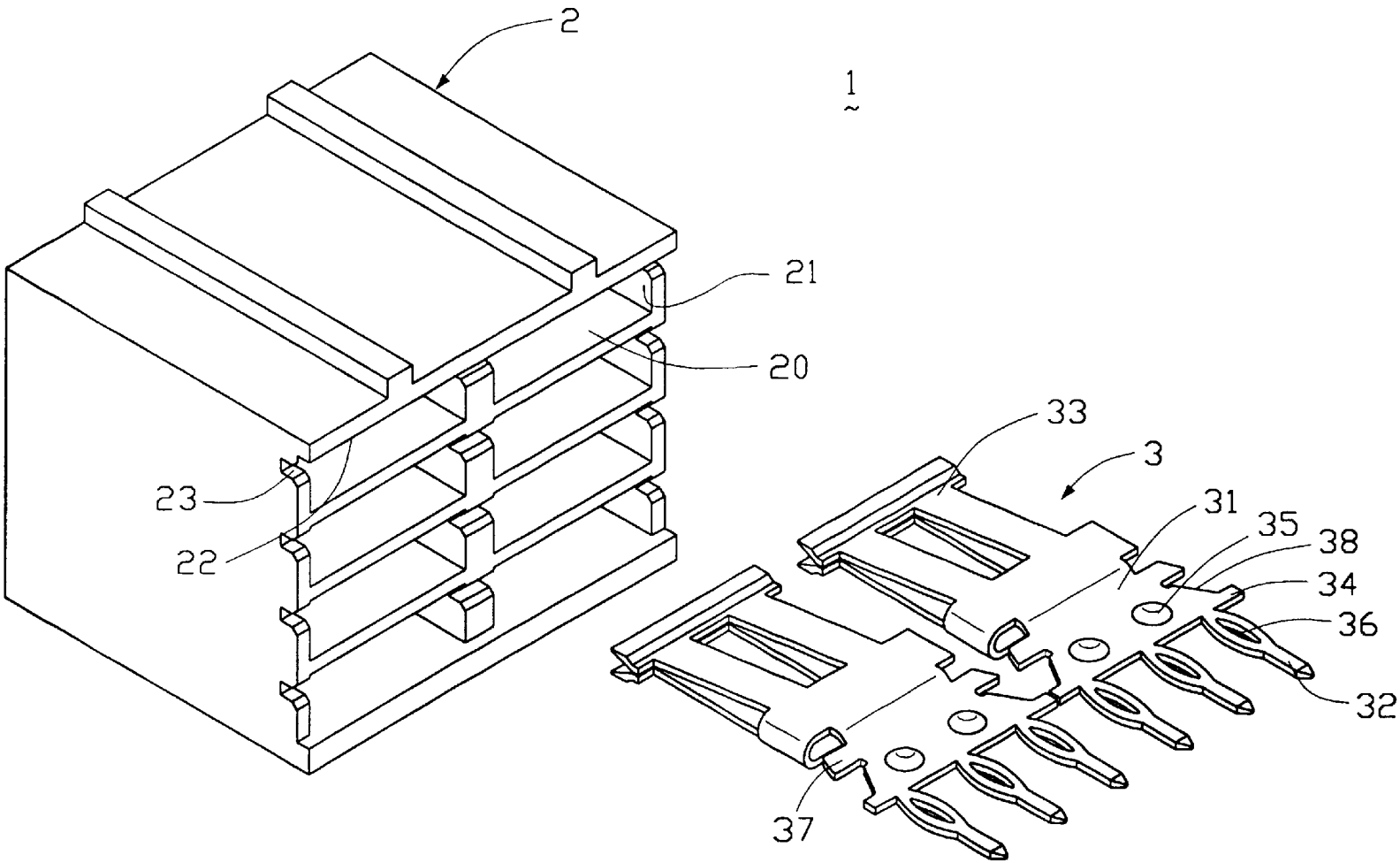
FIG. 1 is an exploded perspective view of an electrical connector in accordance with the present invention.

Reference will now be made to the drawing figures to describe the present invention in detail.

Referring to FIG. 1, an electrical connector 1 of the present invention comprises an insulative housing 2 and a plurality of conductive contacts 3 received in the insulative housing 2 for transmitting electric power.

Figure 2:
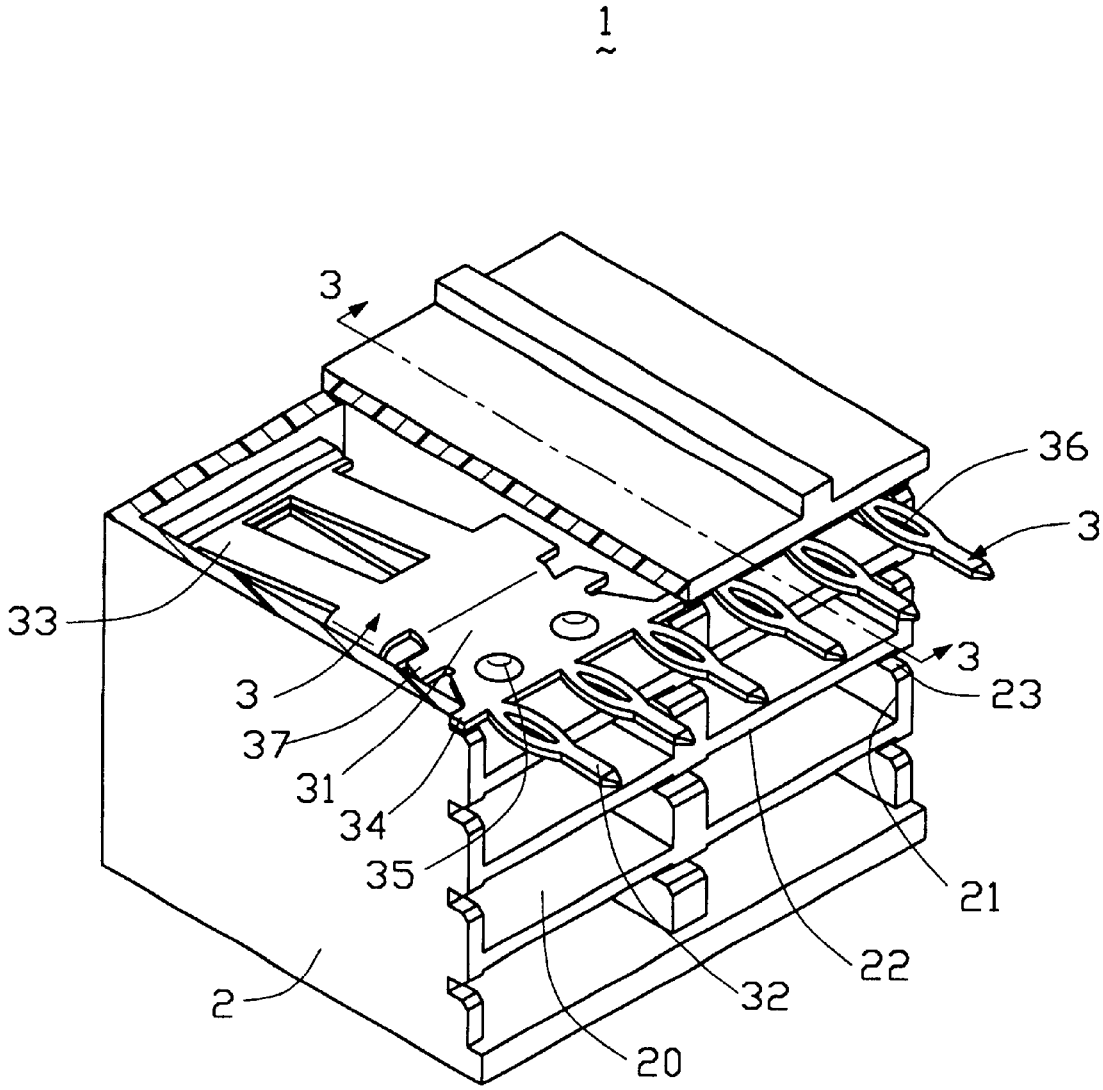
FIG. 2 is a cross-section view of the electrical connector of FIG. 1.

Referring to FIG. 2, the insulative housing 2 defines a plurality of receiving passageways 20 for receiving the conductive contacts 3. The receiving passageways 20 each comprise a pair of opposite side walls 21 and an upper wall 22 between the side walls 21. Each of the side walls 21 defines a mounting channel 23 on a rear end thereof.

The conductive contact 3 comprises a retaining portion 31, a mating portion 33 extending forwardly from the retaining portion 31 and three tail portions 32 extending rearwardly from the retaining portion 31. Both the retaining portion 31 and mating portion 33 are received in the receiving passageways 20. The retaining portion 31 forms a pair of symmetrical mounting shoulders 34 extending outwardly on a rear end of each edge thereof. An inclined side wall 38 extends inwardly and forwardly from an inner portion of the mounting shoulder 34. A plurality of semi-spherical shaped projections 35 extends upwardly from an upper face of the retaining portion 31. In addition, the retaining portion 31 forms a plurality of mounting barbs 37 extending outwardly from a front end of the inclined side wall 38. The conductive contact 3 defines a hole 36 on the tail portion 32.

Figure 3:
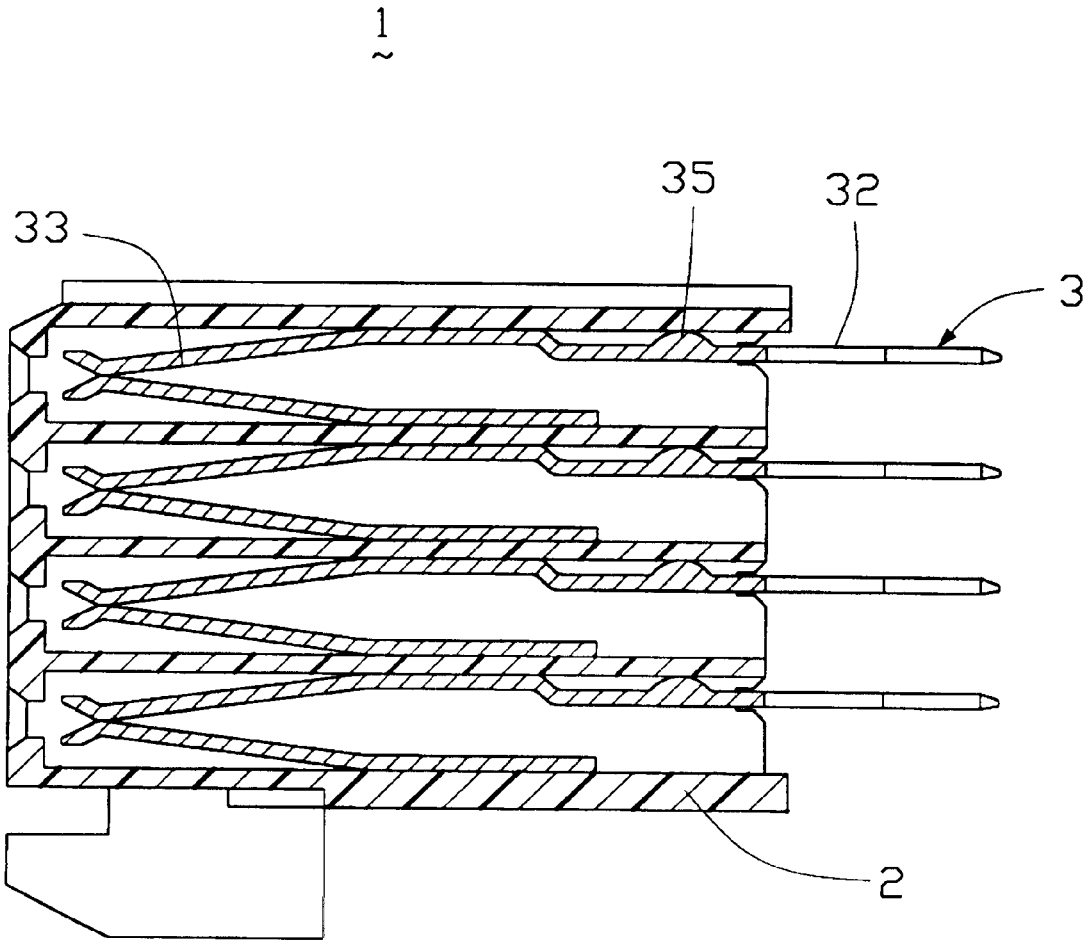
FIG. 3 is a cross-section view along line 4—4 of FIG. 2.
Figure 4:
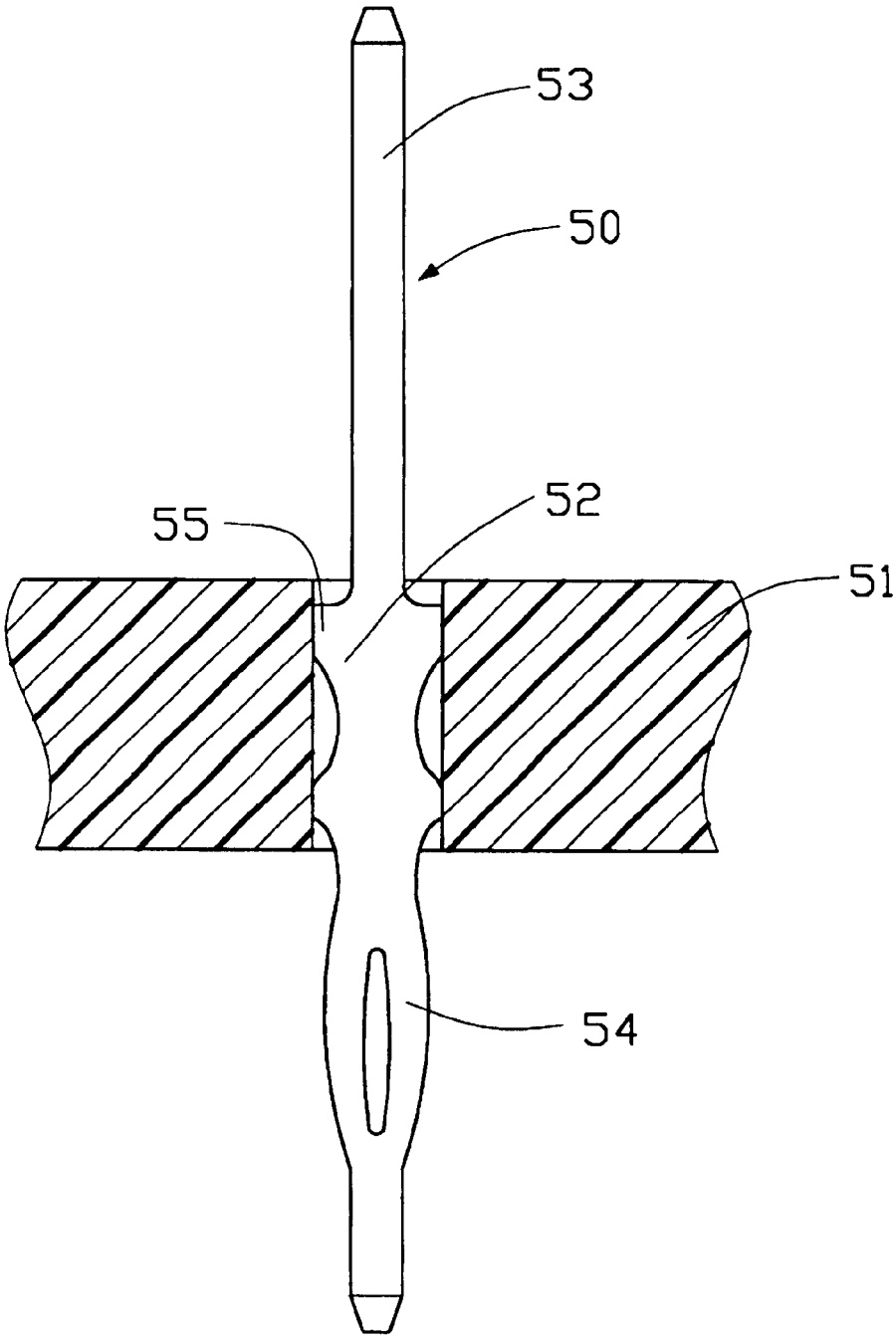
FIG. 4 (PRIOR ART)
FIG. 4 is a cross-section view of a conductive contact assembled in a dielectric housing.

Referring to FIGS. 3 and 4, it can be seen that the conductive contacts 3 are assembled in the insulative housing 2, the mounting shoulders 34 of the conductive contacts 3 are received in the mounting channels 23 of the insulative housing 2, the projections 35 of the conductive contacts 3 interference fit with the upper walls 22 of the receiving passageways 20, and the mounting barbs 37 engage with the side walls 21 of the receiving passageways 20, therefore, the conductive contacts 3 are securely retained in the insulative housing 2. When the electrical connector 1 is inserted into a mating printed circuit board (not shown), the mounting shoulders 34 engage with front walls of the mounting channels 23, and the projections 35 interference fit with the upper wall 22 of the receiving passageway 20. Therefore, the electrical connector 1 electrically connects with the printed circuit board. In addition, the hole 36 of the contact 3 can reduce the mating force between the connector 1 and the printed circuit board. When a mating connector (not shown)

is inserted into the connector 1, the barbs 34 engage with the side walls 21 of the receiving passageways 20 and the projections 35 interfere with the upper walls 22 of the receiving passageways 20. Therefore, the conductive contacts 3 are securely mounted in the receiving passageways 20 and have a stable electrical connection with the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a plurality of receiving passageways, each of the receiving passageways being defined by a pair of opposite side walls and opposite upper and bottom walls between the side walls, each side wall defining around a rear portion thereof a mounting channel communicative with an exterior; and a plurality of contacts respectively received within the corresponding receiving passageways, each of said contacts including a U-shaped mating portion engaged with both the upper wall and the bottom wall, and a retaining portion extending from said mating portion and spaced away from the bottom wall while being close to the upper wall, said retaining portion defining on a rear portion thereof a pair of opposite mounting shoulders each received within the corresponding mounting channel, a plurality of barbs extending outwardly from said retaining portion for engaging with the side walls of the receiving passageway, and a plurality of semi-spherical projections extending upwardly from a face of said retaining portion for interference fitting with the upper wall of the receiving passageway, and a tail portion extending rearwardly from the retaining portion.

* * * * *